United States Patent [19]

Fritz

[11] Patent Number: 4,895,309

[45] Date of Patent: Jan. 23, 1990

[54] IMPACTOR FOR BREAKING LARGE METAL PIECES

[75] Inventor: Leonard Fritz, Romulus, Mich.

[73] Assignee: Fritz Enterprises, Inc., Taylor, Mich.

[21] Appl. No.: 291,374

[22] Filed: Dec. 23, 1988

Related U.S. Application Data

[63] Continuation of Ser. No. 93,631, Sep. 8, 1987, abandoned.

[51] Int. Cl.[4] ..... B02C 13/06

[52] U.S. Cl. ..... 241/186 R; 241/189 R; 241/191; 241/195

[58] Field of Search ..... 241/189 R, 191, 195, 241/27, 274, 186 R, 185 R, 189 A

[56] References Cited

U.S. PATENT DOCUMENTS

| | | | |
|---|---|---|---|
| 1,189,471 | 7/1916 | Ochterbeck | 241/189 R |
| 1,996,485 | 4/1935 | Parker | 241/191 |
| 2,986,347 | 5/1961 | Stevenson | 241/191 |
| 4,046,325 | 9/1977 | Tucsok et al. | 241/195 X |
| 4,650,129 | 3/1987 | Newell et al. | 241/189 R X |

FOREIGN PATENT DOCUMENTS

| | | | |
|---|---|---|---|
| 2255380 | 6/1973 | Fed. Rep. of Germany | 241/189 R |

*Primary Examiner*—Joseph M. Gorski
*Attorney, Agent, or Firm*—Harness, Dickey & Pierce

[57] ABSTRACT

An impactor for breaking large, boulder size, ferrous metal pieces comprises a massive, horizontally axised, cylindrically shaped rotor having spaced apart, outwardly extending, impact heads. The rotor is formed of a number of axially aligned, thick, large diameters disks that are secured together face to face. Deep notches formed in the circumferential edges of the disks provide head mounting pockets within which inner portions of the heads are received. Each of the heads has an outer portion which projects radially outwardly of the rotor and has a small impact area. Large metal pieces are gravity fed, down a chute, into the paths of rotation of the heads impact areas, below the horizontal axis of the rotor. The pieces are struck by the downwardly moving head impact areas to momentarily receive an enormous concentrated force resulting from the rotation of the rotor mass. The forces imparted by the impacts break the metal pieces and pulverize inclusions, such as slag, rocks and the like, and fling the small broken pieces away from the rotor for subsequent collection and removal.

11 Claims, 2 Drawing Sheets

IMPACTOR FOR BREAKING LARGE METAL PIECES

This is a continuation of U.S. patent application Ser. No. 093,631, filed Sept. 8, 1987 entitled IMPACTOR FOR BREAKING LARGE METAL PIECES, and now abandoned.

BACKGROUND OF INVENTION

This invention relates to a machine useful for breaking very large pieces of scrap iron and steel which otherwise cannot economically be fragmented into the smaller sizes required for melting in metal processing furnaces. This machine is particularly adapted to fragmenting large, irregularly shaped scrap chunks of iron and steel that are produced by blast furnaces and steel manufacturing furnace operations.

In the manufacture of iron from ore in a blast furnace, molten slag floats upon the surface of molten iron produced in the furnace from the ore. The slag and the iron are separately tapped from the furnace and commercially used. However, at times the molten material in the interface area, which contains a mixture of slag and iron, is either tapped or is left over in some way so that it must be dealt with separately. That material, when removed from the furnace is solidified into very large, irregular chunks containing mixtures of slag and iron. While these chunks may vary in size and shape depending upon how and where the material is solidified, two forms are common. In one form the metal is poured into and solidified in circular mold-like depressions or slag pots to form large diameter roughly patty shapes which, for example, may be about 4 feet in diameter and roughly 1½ feet thick. In another form, the metal may be in a slab-like shape which, for example, may be 4–5 feet wide, 6–8 feet long, roughly 12–18 inches thick and weigh in the neighborhood of 15–18 tons.

These heavy chunks are too large to be broken into smaller pieces and thrown back into the furnace for remelting and reprocessing. Ordinarily, pieces of about 5–8 inches are the maximum usable size for remelting in a furnace. Conventional hammer mills and other conventional breaking equipment cannot break those large chunks into small enough pieces for reuse. Consequently, the large chunks are simply discarded as waste material by-products of the blast furnace.

A similar problem arises in the manufacture of steel in open hearth or oxygen lance or electric steel making furnaces. From time to time, large, chunks of solidified scrap steel are produced. These chunks or pieces, which typically may be slab-like or more irregular in shape, are too large to economically break up in conventional equipment, such as in conventional hammer mills. Therefore, these chunks are discarded as waste material.

An enormous number of discarded, large, irregularly shaped, slab-like or patty-like pieces or chunks of iron, mixtures of iron and inclusions, or steel and the like has been accumulated in the vicinity of blast furnace and steel furnace facilities. Many of the pieces are so large, that even one or two pieces may be a full cargo for a flat bed truck. For example, a single piece may be 15 to 18 tons in weight. Such a piece is too large to commercially haul any distance or to economically break up into small pieces for reuse.

In some of the older iron and steel manufacturing facilities, the number of discarded large size scrap pieces that have accumulated over the years has created a storage problem. That is, dump areas are filled or nearly filled with scrap. Hauling away the large pieces, to make room for more, is too expensive. Meanwhile, the large amount of discarded iron and steel pieces is a rich, dormant mine containing already processed ferrous metal. That is, as compared with the processing of iron ore, the discarded pieces are already concentrated iron which no longer need complete, costly blast furnace treatment. Summarizing, the accumulated large chunk ferrous scrap material on the one hand, is an ecological and a storage problem and, on the other hand, is a valuable source of ferrous metal if the material can be broken economically into small, useable pieces.

In the past, breaking smaller size chunks of iron or steel has been accomplished by hammer mills. But, even the largest hammer mills are unable to handle very large size discarded scrap pieces. Skull cracker balls, lifted and dropped from cranes, can break up large pieces. But these require too much time, labor and crane machinery to make this economically feasible for continuous use in breaking very large pieces into useable small pieces. For example, a crane and ball might break up only 15 tons a day, which is not enough to be economically feasible.

Thus, there has been a need for a device capable of breaking very large size chunks or pieces of ferrous metal scrap into pieces that are small enough to be handled in conventional ferrous metal processing furnaces.

SUMMARY OF INVENTION

This invention relates to an impactor capable of breaking very large size pieces of iron and steel scrap and the like by imparting enormous forces in concentrated areas against the metal pieces. Such forces break the metal pieces and, simultaneously, pulverize a substantial amount of the inclusions, such as slag, rock and the like trapped within the metal pieces. Thus, small pieces of purer ferrous metal are produced.

The invention contemplates the construction of a massive rotor formed of large, thick, disks which are assembled together to form a single cylindrical rotor. A rotational drive shaft is inserted through central openings in the disks and is fastened to the disks for rotating the rotor.

The disks are provided with deep, large, edge notches within which tooth-like hammers are mounted. These hammers are arranged in angularly staggered rows around the circumference of the rotor. Each of the hammers has a relatively narrow corner or impact area which impacts against metal chunks that are placed in the path of rotation of the hammers.

Large chunks of ferrous metal, as for example, a 15 ton, irregularly shaped slab-like or patty-like piece of iron having slag inclusions, is gravity fed down a chute into the path of the rotating hammers. The resulting impacts of the hammers against the lead edge of the piece, which is somewhat analogous to striking a baseball in mid-air with an enormously powerful bat, fragments the impacted portion of the metal piece and pulverizes much of its inclusions. Continuous feeding of the piece into the path of rotation of the hammers results in successive blows against the unbroken portions of the piece as these portions arrive in the path of the moving hammers. Thus, a very large piece is successively fragmented in a short period of time. For example, an irregular slab of roughly 4 feet width, 6 feet long and 12 inches thick, might be fragmented within a few minutes.

The invention contemplates focusing the enormous momentum forces caused by the rotation of the massive rotor at relatively high speed, so that the forces are transmitted to the large chunks without destructive reactions to the rotor or hammers and without affecting the continuous rotation of the rotor.

It can be seen, that a major object of this invention is to provide a massive rotor that will impact an enormous amount of focused force against a large, irregularly shaped, chunk of ferrous material for rapidly breaking the chunk, but without resultant damage to the impactor.

Another object of this invention is to provide an economical way of forming a massive rotor having numerous hammers projecting from its surface. The hammers may be removed individually and replaced when necessary. The rotor is made so that it can be assembled on site from parts that may be made elsewhere and hauled to the rotor site.

Still a further object of this invention is to provide a massive rotor which can be easily assembled and disassembled and can be manufactured or repaired economically. The rotor and its hammers are so shaped and connected together that they require minimal maintenance and can be uninterruptedly operated for long periods of time.

These and other objects of this invention will become apparent upon reviewing the attached drawings, which form a part of the description.

DETAILED DESCRIPTION

Figure 1:
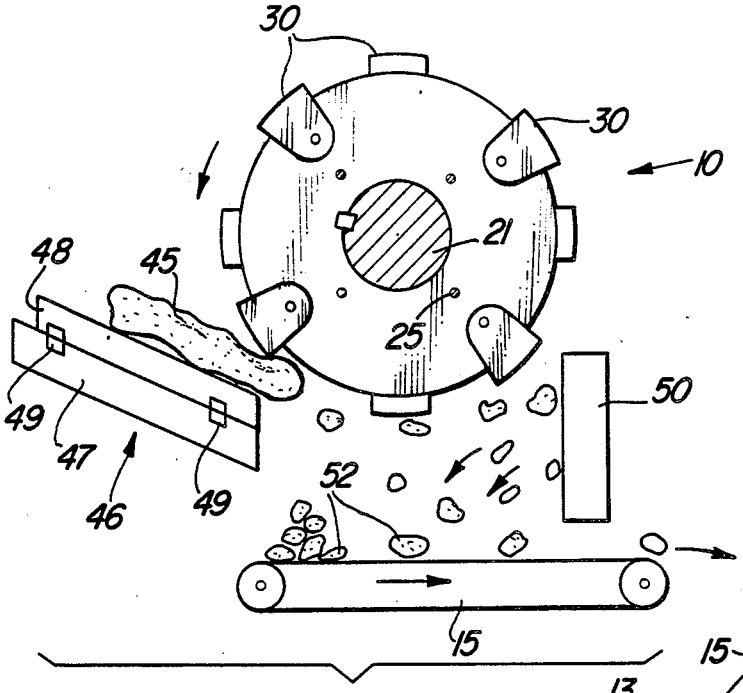
FIG. 1 is a schematic, end view of the impactor.
Figure 3:
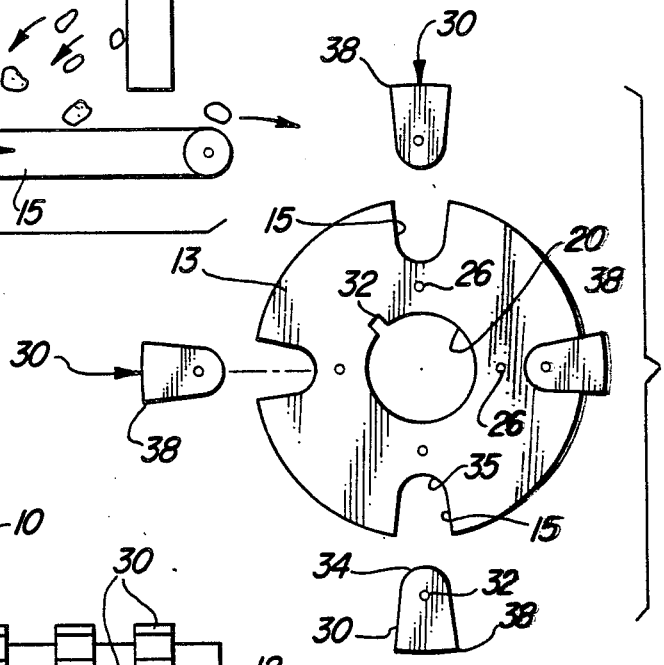
FIG. 3 is an elevational view of one of the disks with its impact heads.
Figure 2:
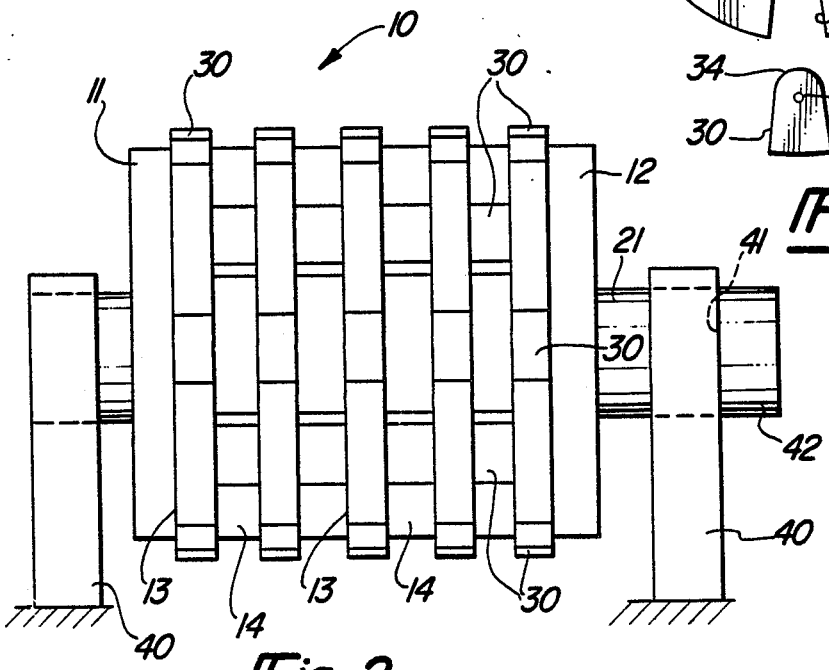
FIG. 2 is an elevational view of the rotor and its opposite supports.
Figure 5:
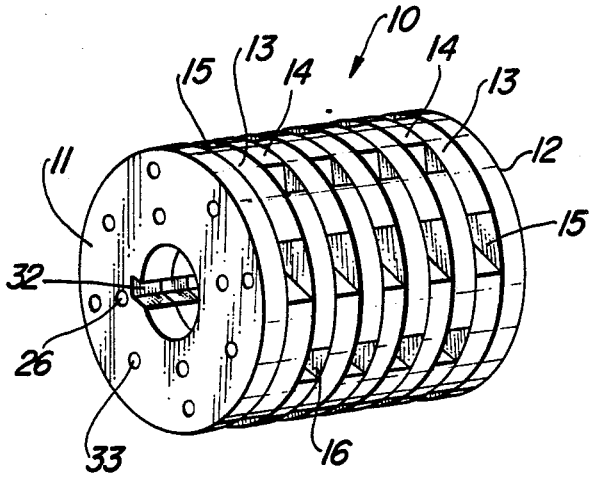
FIG. 5 is a perspective view of the rotor disks.
Figure 6:
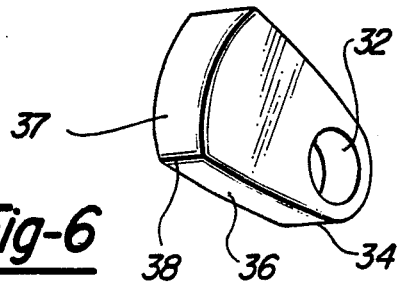
FIG. 6 is a perspective view of one of the impactor heads.
Figure 7:
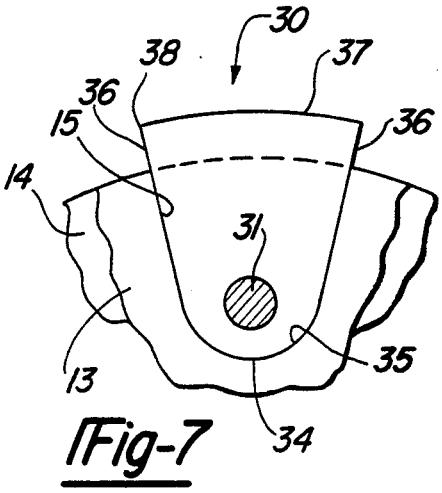
FIG. 7 is a fragmentary view of a head located in its notch in a disk.

As illustrated in FIGS. 1, 2 and 5, the rotor 10 is formed of opposing end plates 11 and 12, between which are located a number of alternating, intermediate disks 13 and 14. Each of the disks is made of a suitable steel casting that may be machined and heat treated as appropriate. By way of example, the disks may be about 12 feet in diameter and approximately 10 inches thick. Thus, each disk is large and heavy. Combining eleven disks together, as illustrated in the drawings, produces a fabricated cylinder which is massive in size and weight.

Each of the intermediate disks 13 is provided with a number of deep notches 15 which form hammer receiving pockets. Similarly, each of the disks 14 are provided with a number of pocket-forming deep notches 16. The notches are aligned in rows, but the rows in the intermediate disks 14 are radially offset relative to the rows of notches in the intermediate plates or disks 13.

A central hole 20 is formed through each of the disks. The holes are aligned to receive a drive shaft 21 which, for example, may be on the order of two and one half feet in diameter. The drive shaft has a key receiving slot 22 running its length and a corresponding key receiving slots 23 are formed in the plates. Thus, a key 24 which is inserted in the aligned key slots fixes the disks to the drive shaft. Preferably, more than one key is used for good load distribution. However, for illustration purposes, only one set of key slots and one key are illustrated.

Figure 4:
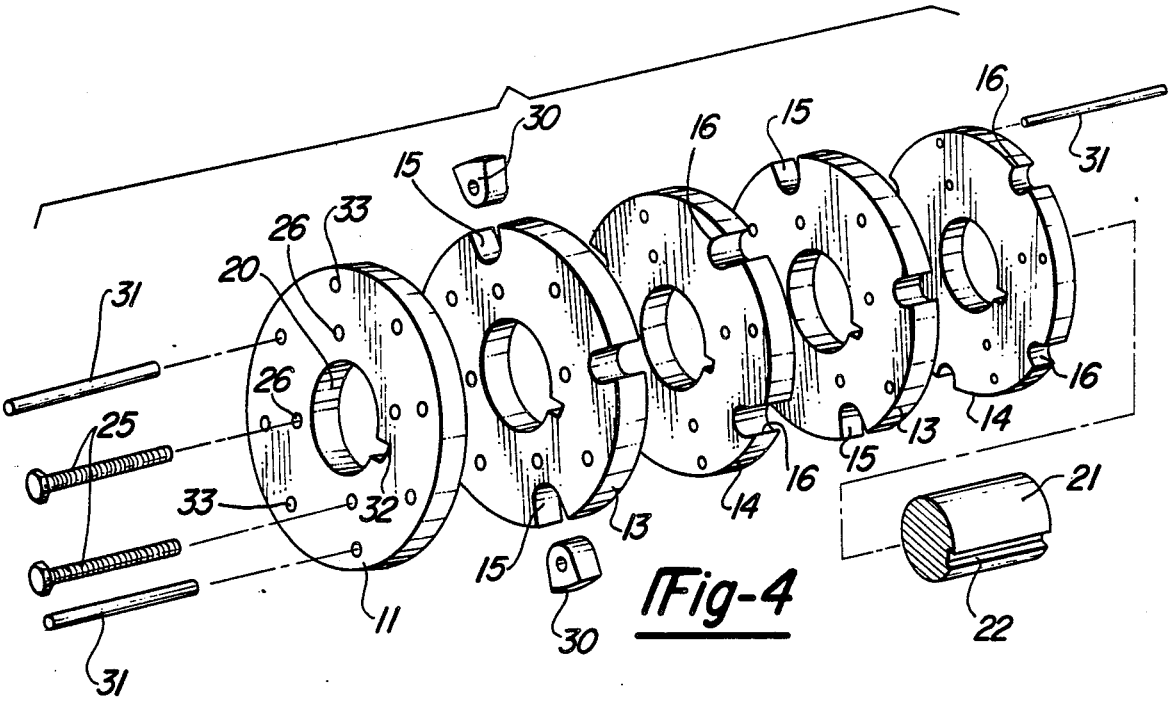
FIG. 4 is a perspective view of a number of the disks shown in disassembled relationship.

The aligned disks are fastened together by elongated bolts 25 extending through aligned bolt receiving holes 26 formed in the disks. These bolts are schematically shown in FIG. 4. When they are extended through the aligned bolt holes, they are fastened in place by suitable nuts (not shown).

Each of the notches 15 and 16 receives a hammer 30. The hammers are made of a suitable steel casting which is close in thickness dimension to the disks. Preferably, however, the thicknesses of the hammers are slightly less than the thicknesses of the disks, as for example, about one half inch thinner than the disks.

The hammers are secured within their respective notches, which form pockets for the hammers, by elongated pins 31 that extend through holes 32 in the hammers and aligned holes 33 in the plates. As can be seen, each of the notches or pockets opens radially outwardly at the circumference of the rotor, but is closed along its sides by the next adjacent disk or plate which contains holes 33 for receiving the pin that secures the particular hammer in place.

Preferably, the inner ends 34 of the hammers are rounded or curved and are seated against rounded or curved notch inner ends 35. This insures good fitting and good load or force transmission between the hammers and the rotor.

Preferably the sides 36 of the hammers are slightly tapered and the free ends 37 of the hammers are curved. Thus, the junctures between the curved free ends and the tapered sides provide corners 38. These corners form elongated, narrow impact areas. By way of example, the corners, which may be slightly rounded, form a relatively narrow line of roughly one quarter inch thickness. The width of that line may vary depending upon the degree of roundness of the corner. Thus, a 10-inch thick hammer provides a narrow contact area of roughly two and one half square inches which highly concentrates the impact force of the hammer.

The opposite ends of the drive shaft 21 are mounted within supports 40 having mounting or bearing openings 41. A free end 42 of the shaft may be suitably connected, as by gears or the like, to a power source, such as one or more diesel engines or electric motors for providing the needed horse power to rotate the shaft.

In operation, referring to FIG. 1, the rotor is turned by the power source at a predetermined speed. For example, utilizing a pair of large diesel engines which are operated together, a drive force of about 4,000 horse power rotates the shaft and the rotor in the range of between about 450 and 550 rpm. If the steel disks are about ten inches thick and about twelve feet in diameter, a force will be developed, due to the momentum of the rotating mess, in the range of about 120 million foot-pounds. This force will be divided among the particular hammers which strike a chunk of metal at any one time. For example, if all four hammers in one row strike a large chunk of metal, each hammer will receive one fourth of the 120 million foot-pounds or about 30 million foot-pounds concentrated in a narrow, elongated, roughly two and one half square inch area.

As illustrated in FIG. 1, large, irregularly shaped, slab-like chunk 45 of ferrous metal, as for example about 4–5 feet wide, about 10–18 inches thick and about 6–8 feet long, are gravity fed down a chute 46 into the path of rotation of the hammers. The chute itself is provided with a rigid, fixed support 47 upon which a thick, steel, covering slab 48 is located. The slab is held in place by suitable brackets, which are schematically shown at 49. As the lead end of the covering slab is broken, which occurs from time to time during operation, the covering slab may be loosened, relative to its fastening brackets 49, and moved endwise down the support a sufficient distance to maintain the covering over the chute.

The impacted, lead end portion of the large metal chunk is unsupported by the chute. Consequently, the impacted portions are struck in a manner similar to a baseball which is struck in mid-air by a swinging bat. The impacted portions of the chunk are sheared and fragmented by each successive row of hammers as the hammer rows swing about and strike the portion of the chunk, which moves into the paths of the hammers. Therefor, bit by bit the chunk is demolished. The number of successive hammer impacts needed to completely fragment a particular chunk depends upon the size of that specific chunk.

A heavy wall 50 is positioned on the side of the rotor which is opposite to the place where the chunks are impacted by the hammers. This wall may be made of large steel ingots, for example. Beneath the rotor a suitable automatic conveyor 51, which is shown schematically in the drawings, is positioned. Consequently, the fragments or small pieces 52 which are broken or fragmented from the chunks of metal 45, are hurled or flung through the space beneath the rotor against the wall 50. The impacts with the wall may cause further breakage of the fragments. The fragments rebound or are deflected backwardly from the wall into the space beneath the rotor where they collect upon the conveyor which carries them away.

The impact force against the large metal chunks is so great that inclusions, such as slag or rock or the like, which are typically found in large scrap metal pieces of iron from a blast furnace slag-iron interface zone, are pulverized. That is, a substantial part of the slag or the like inclusions in areas exposed by the fragmentation of the chunks, break up into sand-like particles which fall down upon the conveyor and are subsequently removed.

Because of the slight taper of the sides 36 of the hammers, the impact areas at the corners 38 are a few degrees advanced relative to the disks sockets into which the hammers are fitted. This prevents the collection of small sized debris or sand-like particles, between the lead wall of each notch and the lead face of the hammer located in that notch. As mentioned above, preferably the hammers are slightly thinner than the disks in which they are fitted. In the event a hammer deforms or mushrooms due to the repeated impacts, there is a slight amount of space available for the hammers to expand sideways. That slight expansion into the small amount of space between the faces of the hammers and their adjacent disk or plate faces, avoids the hammers binding within the notches. If such binding occurred, it would be necessary to remove the hammers from their notches with a cutting torch. By avoiding such binding, the hammers can be simply pulled out endwise from their notches when any replacement of a hammer is desirable.

Preferably, the equipment is surrounded by a large housing (not shown) which can be opened for removal of the rotor or for removal and replacement of any hammer. The particular size and shape of the housing is not material.

Due to the massiveness of the rotor and the enormous momentum of the rotating rotor, large chunks of iron or steel, which previously could not be economically fragmented, can now be smashed into pieces by a series of impacts. Despite the on-going impacts, however, the massive rotor rotates smoothly, without hesitating and without damage due to reaction forces, during these impacts.

Having fully described an operative embodiment of this invention, I now claim:

1. An impactor for breaking large size, substantially solid, ferrous metal pieces into smaller pieces, comprising:

a massive, cylindrically shaped rotor having a horizontal axis, said rotor formed of a number of axially aligned, thick, large diameter, metal disks each having a circumferential edge, said disks fastened together in face to face relationship to form the rotor;

spaced apart, deep notches formed in the circumferential edges of the disks, with the notches located between end plates located at opposite ends of the rotor;

each notch having opposite sides covered by a face of the next adjacent disk, and each notch defined in said disk by a pair of opposing side walls connected at one end by a curved bottom wall and being open at the circumferential edge of its disk, said sidewalls diverging from said curved bottom wall such that each notch is wider at the circumferential edge than at the curved bottom;

an impact head rigidly mounted in each notch, with each impact head having an inner portion having a shape corresponding to said notch, which inner portion is inserted through the circumferential edge opening and received within the notch, and an outer portion extending radially outwardly of its respective notch, each of said impact heads being close to the same thickness as their notched disks and having its inner portion substantially and completely filling its respective notch;

the outer portion of each impact head extending from the circumferential edge of its disk a distance less than the depth of the notch and having an exposed curved free end substantially parallel to the circumferential edge of its disk with the outer portion of each impact head having side faces and an end face which form a corner at their juncture with its exposed curved free end, with the corners forming the impact area of the head for concentrating the force of the rotor;

means for rotating the rotor about its horizontal axis at predetermined speeds;

means for feeding large, substantially solid metal pieces into the paths of rotation of the impact areas of the impact heads;

so that the impact areas each momentarily impact enormous concentrated forces upon any large pieces of metal in its path to break the large pieces into small pieces, as well as to disintegrate into small particles substantial parts of any inclusions contained within the large pieces, with the exposed curved free ends of the impact heads following along the path of the impact areas through the large piece of metal.

2. An impactor as defined in claim 1, and with the notches in the disks being aligned in rows that are generally parallel to the horizontal axis of the rotor, but with the rows of alternate disks being radially off-set from the rows in their adjacent disks.

3. An impactor as defined in claim 3, and with the impact heads in each row being secured within their notches by removable pins extending through aligned openings in all of the impact heads in that row and in the adjacent, unnotched disk portions aligned with that row;

so that endwise removal of any pin permits removal of the impact heads in the row secured by that pin.

4. An impactor as defined in claim 1, and the thickness of the impact heads being slightly less than the thickness of their notched disks to provide a slight amount of clearance between adjacent surfaces of the impact heads and the adjacent disks which cover their respective notches, so that any slight distortion of the impact heads due to operation of the impactor will not bind the impact heads against removal through the open ends of their notches.

5. An impactor as defined in claim 1, and with all of the aligned disks being secured together by a number of elongated fastening bolts that are parallel to the horizontal axis of the rotor and extend through all of the disks, so that by removal of the bolts, the disks may be separated.

6. An impactor as defined in claim 6, and with each of the disks having a large, central opening, and with a large diameter, central drive shaft extending through the central openings in the disks, and fastening means securing the disks to the shaft.

7. An impactor as defined in claim 5, and said disks being of sufficient diameter and thickness to provide a sufficient massive amount of momentum for continuous, smooth rotation of the rotor notwithstanding the impacts of the impact heads with the metal pieces.

8. An impactor as defined in claim 7, and wherein said disks are roughly twelve feet in diameter and roughly ten inches in thickness, and wherein upon rotation at between about 450–550 revolutions per minute, the rotor mass provides a momentum force of roughly in the range of 120 million foot pounds.

9. An impactor as defined in claim 1, and said means for feeding the large metal pieces includes means for positioning the large metal pieces in the paths of the impact areas below the horizontal axis of the rotor, along one side of the rotor, so that the pieces are struck in a generally downwardly direction.

10. An impactor as defined in claim 9, and said means for feeding the large metal pieces includes a chute formed of a fixed, elongated base, and a selectively movable, thick metal slab cover arranged upon the fixed base, and including means mounting the thick metal slab for endwise movement upon the fixed base towards the rotor, when desired, to replace slab end portions that may be broken off during operation of the rotor.

11. An impactor as defined in claim 9, and including a generally vertical wall arranged at least at the lower part of the rotor on the opposite side from the location where the impact heads impact the pieces, with the area beneath the rotor and between the wall and said location being an open space so that broken pieces may be flung either downwardly through the space or against the wall for deflection downwardly through the space or back into the path of the rotating impact heads, wherein the broken pieces may be collected beneath said space.

* * * * *

UNITED STATES PATENT AND TRADEMARK OFFICE

CERTIFICATE OF CORRECTION

PATENT NO. : 4,895,309

DATED : January 23, 1990

INVENTOR(S) : Leonard Fritz

It is certified that error appears in the above-identified patent and that said Letters Patent is hereby corrected as shown below:

In claim 3, col. 7, line 6, change "as defined in claim 3" to --as defined in claim 2--

In claim 6, col. 7, line 29, change "as defined in claim 6" to --as defined in claim 5--

Signed and Sealed this

Second Day of July, 1991

*Attest:*

HARRY F. MANBECK, JR.

*Attesting Officer*

*Commissioner of Patents and Trademarks*